United States Patent [19]

Stasiuk

[11] Patent Number: 4,893,598

[45] Date of Patent: Jan. 16, 1990

[54] PRE-START LUBRICATOR

[75] Inventor: Michael Stasiuk, Vancouver, Canada

[73] Assignee: Stasiuk Engineering Ltd., Vancouver, Canada

[21] Appl. No.: 339,699

[22] Filed: Apr. 18, 1989

[51] Int. Cl.[4] ..... F01M 1/00

[52] U.S. Cl. ..... 123/196 S; 123/196 R; 184/6.4

[58] Field of Search ..... 123/196 R, 196 S, 198 D; 184/6.3, 6.4

[56] References Cited

U.S. PATENT DOCUMENTS

| | | | |
|---|---|---|---|
| 2,747,564 | 5/1956 | Wehling | 123/196 S |
| 3,425,404 | 2/1969 | Lamkin | 123/196 S |
| 3,722,623 | 3/1973 | Waldecker | 123/196 S |
| 4,168,693 | 9/1979 | Harrison | 123/196 S |
| 4,458,644 | 7/1984 | Papst | 123/196 R |
| 4,502,431 | 3/1985 | Lulich | 123/196 S |
| 4,524,734 | 6/1985 | Miller | 123/196 R |
| 4,553,512 | 11/1985 | Showman | 123/196 S |
| 4,628,877 | 12/1986 | Sundles et al. | 123/196 S |
| 4,703,727 | 11/1987 | Cannon | 123/196 S |

*Primary Examiner*—E. Rollins Cross

*Attorney, Agent, or Firm*—Murray E. Thrift; Stanley G. Ade; Adrian D. Battison

[57] ABSTRACT

An oiling apparatus for an internal combustion engine serviced for pre-oiling the engine before the engine is started. The apparatus includes a manually operated positive displacement oil pump with an inlet at one end and an outlet at the other. An oil suction line connects the pump inlet to the oil sump of the engine, while an oil feed line connects the pump outlet to an oil gallery of the engine through the fitting usually provided for a pressure light or gage sender unit. An oil pressure switch in the feedline is normally open and closes when the oil pressure in the feedline is greater than that necessary to pre-oil the engine. The ignition switch of the engine is connected in series with the oil pressure switch between the battery and the starter motor relay so that the starter motor is disabled until the oil pressure in the feedline is sufficient to close the oil pressure switch.

8 Claims, 5 Drawing Sheets

PRE-START LUBRICATOR

FIELD OF THE INVENTION

The present application relates to an oiling apparatus for internal combustion engines and more particularly to apparatus that may be used for pre-oiling such engines before start-up.

BACKGROUND

Internal combustion engines are subjected to considerable wear of their components on start-up, before the lubricating oil normally contained within the engine sump is distributed through the engine by the engine driven oil pump. This is a particular disadvantage with engines that are frequently started and stopped and that are intended to have a very long service life.

Various pre-oiling devices have been proposed in the past. These usually include oil accumulators or power operated pumps and control systems that make them quite expensive.

SUMMARY OF THE INVENTION

The aim of the present invention is to provide a relatively simple, yet reliable pre-oiling system that can be sold and installed at modest cost.

According to the present invention there is provided an oiling apparatus for an internal combustion engine comprising:

a manually actuated positive displacement oil pump with an inlet and an outlet;

an oil suction line connecting the oil pump inlet to an engine oil sump;

an oil feed line connecting the oil pump outlet to an oil gallery in the engine;

an oil pressure switch in the oil feed line, normally open and closing in response to the presence of an oil pressure in the feed line greater than a predetermined pressure;

an ignition switch, normally open, and selectively closed by an operator for starting the engine;

a relay switch, normally open, with two switched terminals and a coil;

a starter motor;

an electric battery;

a first electric line connecting the battery to the relay coil through the ignition switch and the oil pressure switch such that the coil is energized and the switched terminals of the relay are closed only when the ignition switch is closed and the oil pressure in the oil feedline is above said predetermined oil pressure;

a second electric line connecting the battery to the starter motor through the switched terminals of the relay, such that the starter motor is disabled until the ignition switch is closed and the oil pressure in the feed line is above said predetermined pressure.

BRIEF DESCRIPTION OF THE DRAWINGS

In the accompanying drawings, which illustrate an exemplary embodiment of the present invention.

DETAILED DESCRIPTION

Figure 1:
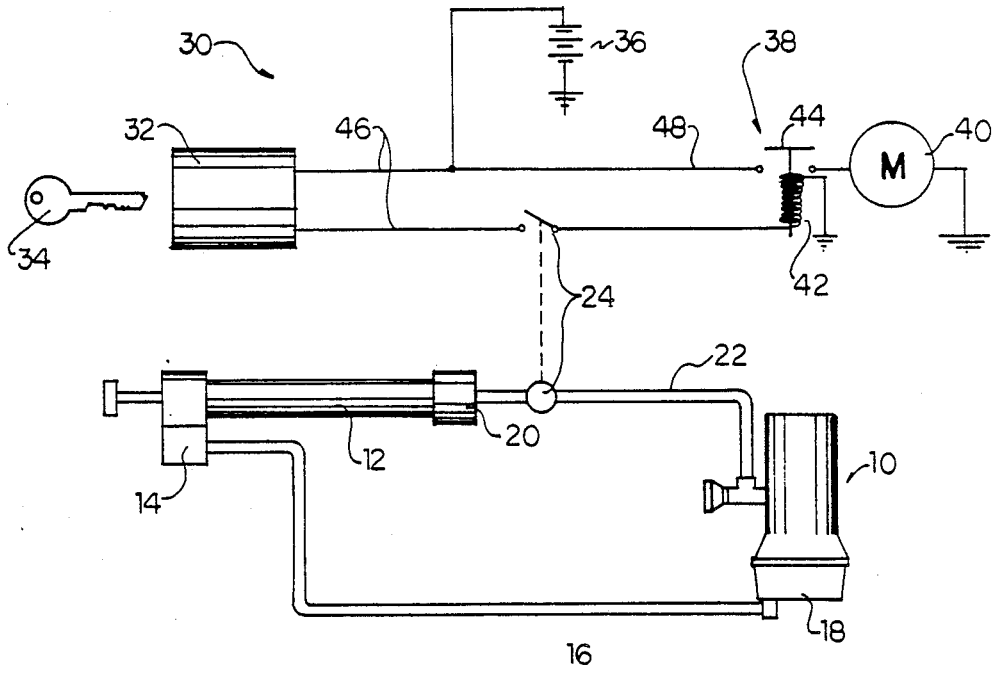
FIG. 1 is a schematic view of an oiling apparatus according to the present invention.

Referring to to the accompanying drawings, especially FIG. 1, there is illustrated an oiling apparatus for an internal combustion engine 10. The oiling apparatus includes a manually actuated positive displacement oil pump 12 with an inlet 14 connected to the engine 10 by an oil suction line 16 to draw oil from the engine sump 18. The pump has an outlet 20 that is connected to an oil gallery in the engine by an oil feed line 22. An oil pressure switch 24 in the line 22 is normally open and closes in response to an oil pressure in the outlet line higher than a preset pre-oiling pressure. Thus, the oil pump 12 is operated to draw oil from the sump 18 and feed it into the oil galleries of the engine under pressure. When the pressure reaches a level at which it can be considered that the engine has been completely prelubricated, that is all of the bearings and wear parts have been provided with an adequate amount of oil, the switch 24 will close.

The oil pressure switch 24 is part of an electric circuit 30 that includes an ignition switch 32 that is normally open and that may be closed through the use of a key 34 by an operator. The electric system also includes a battery 36, which is typically an automobile 12 volt battery, a relay 38 and a starter motor 40. The relay 38 has a coil 42 and a pair of switched contacts 44. An electric line 46 connects the battery 36 to the coil 42 of the relay 38 through the ignition switch 32 and the oil pressure switch 24. When the ignition switch 32 is closed through the use of the key 34, the line is maintained open until the oil pressure in feed line 22 reaches the predetermined level indicating that the engine 10 has been adequately pre-lubricated. At that time, the oil pressure switch 24 closes and the relay 38 is actuated. A second electric line 48 connects the battery 36 to the starter motor 40 through the switched terminals 44 of the relay 38. Thus, when the relay 38 is actuated, the contacts 44 close and the starter motor runs. As will therefore be apparent, the oil pressure switch 24 disables the starter motor 40 until the pump 12 has been used to provide adequate pre-lubricating pressure to the engine 10 through feedline 22.

Figure 2:
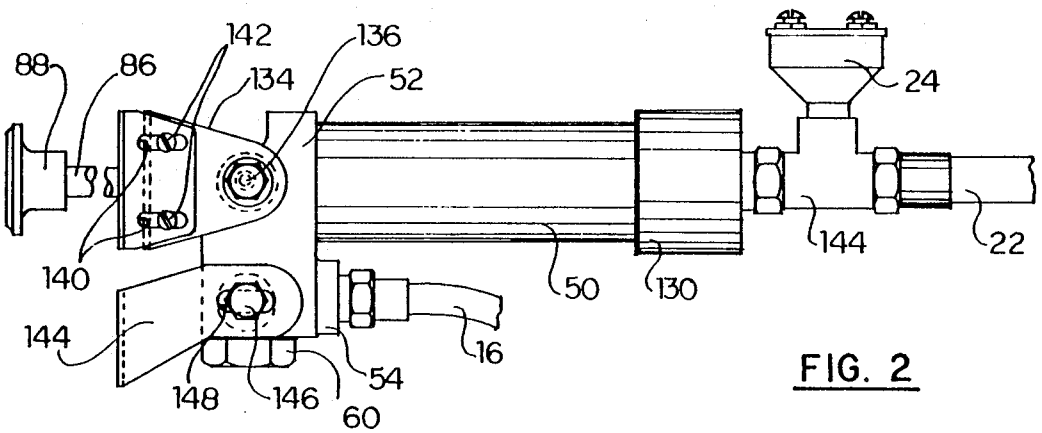
FIG. 2 is an elevation of an oil pump used in the system of FIG. 1.
Figure 3:
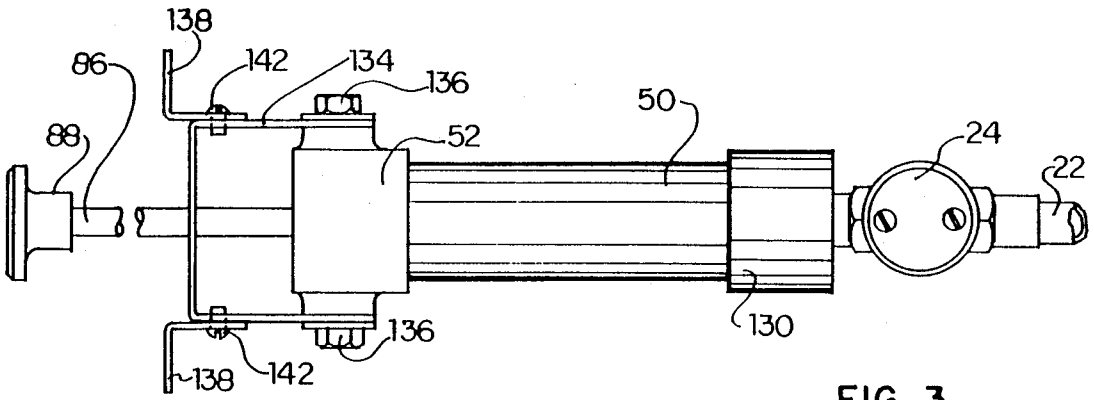
FIG. 3 is a plan view of the pump in FIG. 2.
Figure 6:
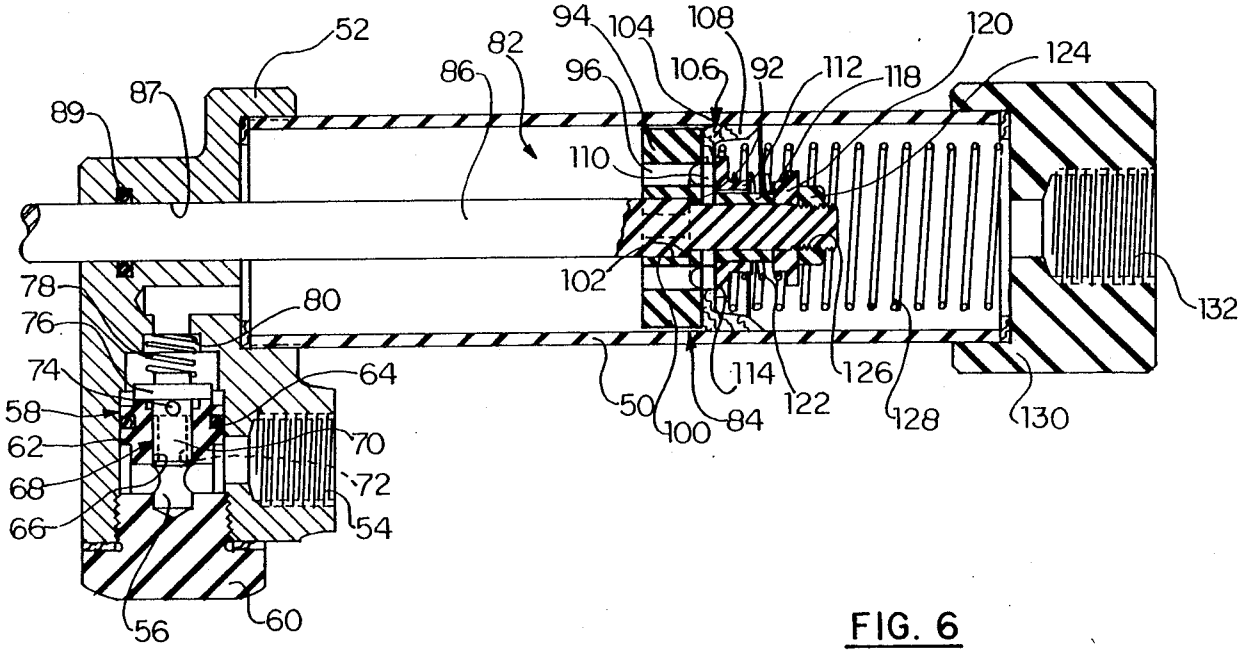
FIG. 6 is a sectional view of the pump of FIG. 2.

The oil pump used in this system is most particularly illustrated in FIGS. 2, 3 and 6. The pump consists of a cylinder 50 with an inlet head 52 fitted to one end. The inlet head projects to one side of the cylinder and accommodates an inlet port 54 leading into a transverse valve chamber 56. The valve chamber is a bore into the inlet head 52 from one side to accommodate a check valve 58. The valve is retained in the valve chamber 56 by a closure plug 60 threaded into the outer end of the chamber. The check valve has a valve body 62 sealed to the inside of the valve chamber by an O-ring 64. An axial bore 66 through the valve body accommodates a valving element 68 with a cylindrical body 70 slideable in the bore 66. The body 70 is itself provided with an axial bore 72 leading to radial ports 74 immediately adjacent a radial flange 76 that serves as a valve seat abutting the end of the valve body 62 in the closed position of the valve. The check valve is kept in its closed position by a coil spring 78 extending between the flange 76 and a spring seat 80 on the inlet head.

The cylinder 50 accommodates a piston 82 that includes a piston head 84 and a rod 86 projecting from the piston head through a bore 87 in the inlet head to terminate in a hand knob 88. The piston rod 86 is sealed to the inlet head by an O-ring seal 89.

The distal end of the piston rod 86, adjacent the head 84, is of reduced diameter to provide a shoulder 92 facing away from the inlet head 52. This end of the rod 86 accommodates a piston disk 94 with a series of axial bores 96 therethrough. A circumferential groove joining the ends of the axial bores is formed in that face of the disk 94 facing away from the inlet head 52. The disc also has a central axial bore 100 formed with an internal shoulder 102 facing towards the inlet head so as to engage the shoulder 92 on the piston rod 86. A cup-shaped seal 104 with an annular base 106 and a cylindrical flange 108 is fitted to the piston rod 86 on the side away from the inlet head 52, with the base lying flat on the face of the disk 94. The seal is provided with axial ports 110 that communicate with the groove 98 in the disk 94. The seal 104 may be elastomeric or leather, provided the seal against the cylinder 50 is adequate and the material is resistant to the oil being pumped.

A valve element 112 closes the ports 110 through the seal 104. The valve element consists of an annular flange 114 lying flat on the seal to close the ports and a cylindrical flange concentric with the rod 86 and sliding on a cylindrical spacer 118 extending from the seal 104 to a spring seat 120 also fitted around the rod 86. A coil spring 122 extends between the spring seat 120 and the valve element 112 to bias the valve element 112 into sealing engagement with the seat 104 to maintain the ports 110 normally closed. A nut 124 is threaded onto the end of the rod 86 by threads 126 to hold the piston head assembly 84 together. A coil spring 128 extends between the piston head 84 and an outlet head 130 closing the end of the cylinder 50 remote from the inlet head 52. The outlet head is secured to the cylinder and contains an outlet port 132 concentric with the cylinder 50.

A mounting bracket 134 is secured to the inlet head 52. The bracket is in the form of a yoke secured to the head 52 by two bolts 136, as most particularly illustrated in FIG. 3. The yoke carries two angle brackets 138 that are connected to the yoke by machine screws 142 passing through slots 140 in the angle brackets and into the threaded bores in the yoke. A second mounting bracket 144 is connected to the inlet head 52 as shown in FIG. 2. This bracket is connected to the head by bolts 146 passing through slots 148 in the bracket and into threaded bores (not shown) in the head. The brackets allow an effectively universal mounting of the oil pump.

The mounting shown is for vehicles (automobiles, trucks, tractors, etc.) with automatic transmissions and stationary motors which must be manually actuated. For manual transmissions the pre-start lubricator is connected to the clutch disengagement linkage. To start the motor, the clutch is disengaged, which pressurizes the oil system, thereby enabling the motor to start.

The outlet port 132 of the pump is connected to a Tee-fitting 144 that accommodates the oil pressure switch 24.

Figure 4:
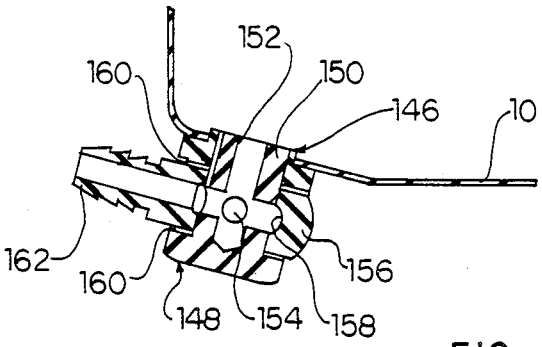
FIG. 4 is a sectional view of an oil drain plug outlet employed in the system of the present invention.

FIG. 4 illustrates the drain plug fitting for withdrawing oil from the sump 18 of the engine. The conventional drain plug outlet 146 of the engine is fitted with a fitting 148 that includes a threaded plug 150 with an axial bore 152 from the inside end of the plug and a series of radial ports 154 intersecting the axial bore. A ring 156 surrounds the plug 152 with an internal groove 158 of the ring communicating with the ports 154. A pair of gaskets 160 on opposite sides of the ring seal the ring against the drain plug outlet 146 and the head of the plug 150 to avoid leakage, while allowing the ring to rotate on the plug 150 for adjustment purposes. A hose-fitting 162 projects from the ring 156 and communicates with the groove 158 and, through the ports 154 and bore 152, with the oil sump of the engine. The hose fitting 162 connects to the oil suction line 16.

Figure 5:
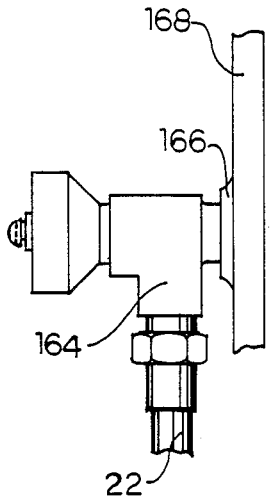
FIG. 5 is a side elevation of an oil feed line connection to an engine block.

FIG. 5 illustrates the oil feed fitting to the engine. This is a Tee 164 that is fitted to a port 166 in the engine block 168 that is normally used to accommodate the sending unit for an oil pressure light or an oil pressure gage. The sending unit in this system is fitted to the Tee and continues to serve its normal purpose. The other branch of the Tee is connected to the oil feed line 22 from the oil pump.

Figure 7:
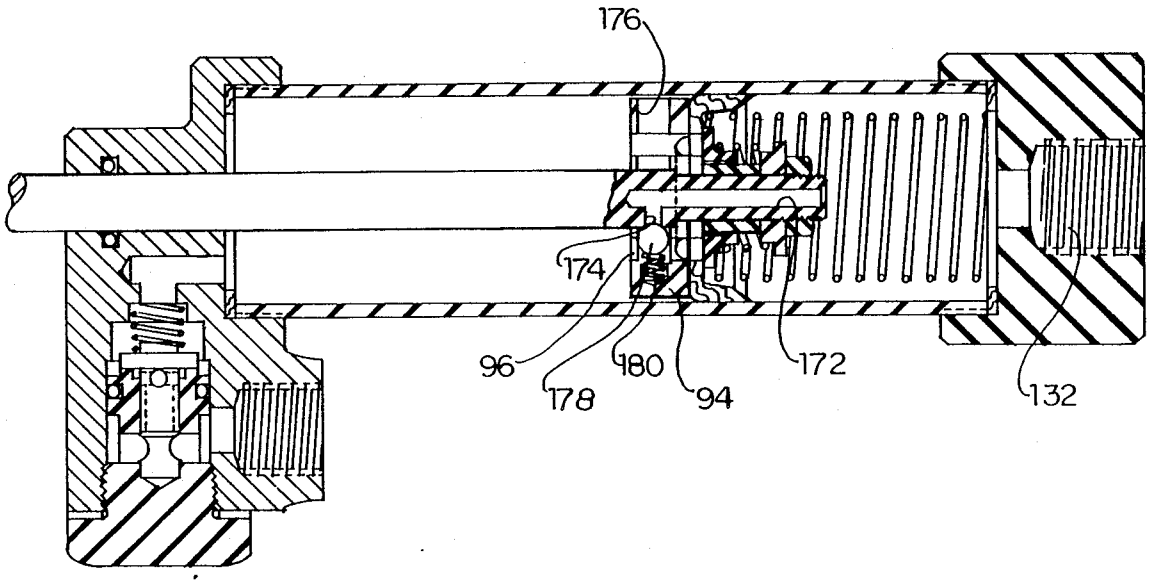
FIG. 7 is view like FIG. 6 showing an alternative embodiment of the pump.

FIG. 7 of the drawing illustrates an alternative embodiment of the pump, which is in most respects the same as the pump illustrated in FIG. 2, 3 and 6. In this case however, the pump is equipped with an over pressure relief valve. This valve consists of an axial bore 172 in the piston rod 86, extending in from its distal end. A radial port 174 is connected to the bore 172 and is located between the radial faces of the disk 94. A radial bore 176 in the disk accommodates a ball 178, that serves as a valving element, and a radial coil spring 180 biasing the ball into engagement with the end of the port 174 to maintain the port in a closed condition. The bore 176 intersects one of the axial bores 96 in the disc 94. The ball and spring serve as a check valve that will remain closed during normal operation of the pump. Should the pressure in the outlet 132 exceed a desired maximum, further operation of the pump will exert sufficient pressure on the ball 178 to unseat it against the force of spring 180. This will allow the over pressure oil to escape from the outlet side of the piston through the piston head to the inlet side.

In operating the pump, an operator will grasp the handle and drive the piston rod and piston head towards the outlet end of the cylinder 50. This will create a reduced pressure on the inlet side of the piston head and on the outlet end of the check valve 58. The oil in the inlet port will act on the under side of the valving element flange 76 to lift it off the valve seat to admit oil through the check valve into the inlet end of the cylinder 50. On the return stroke, the check valve is closed and pressure builds up on the inlet side of the piston. This pressure acts on the valve element 112 through the bores 96 in the disk 94 and the ports 110 in the seal 104 to lift the valve element 112 off the ports 110 and to pass the oil through to the outlet side of the cylinder 50. On the next forward stroke, the piston head 84 is driven towards the outlet, the valve element 112 is closed and the oil is driven out through the outlet port 132 against whatever back pressure is present.

The pump may be operated until the sending unit 170 indicates adequate oil pressure, at which time the engine 10 may be started.

While one particular embodiment of the invention and two specific embodiments of the pump have been described in the foregoing , it is to be understood that the invention is not to be considered limited to these specific embodiments and is intended to be limited only by the scope of the appended claims.

Embodiments of the invention in which an exclusive property or privilege is claimed or defined as follows:

1. An oiling apparatus for an internal combustion engine comprising:

a manually actuated positive displacement oil pump with an inlet and an outlet;

an oil suction line connecting the oil pump inlet to an engine oil sump;

an oil feed line connecting the oil pump outlet to an oil gallery in the engine;

an oil pressure switch in the oil feed line, normally open and closing in response to the presence of an oil pressure in the feed line greater than a predetermined pressure;

an ignition switch, normally open, and selectively closed by an operator for starting the engine;

a relay switch, normally open, with two switched terminals and a coil;

a starter motor;

an electric battery;

a first electric line connecting the battery to the relay coil through the ignition switch and the oil pressure switch such that the coil is energized and the switched terminals of the relay are closed only when the ignition switch is closed and the oil pressure in the oil feedline is above said predetermined oil pressure;

a second electric line connecting the battery to the starter motor through the switched terminals of the relay, such that the starter motor is disabled until the ignition switch is closed and the oil pressure in the feed line is above said predetermined pressure.

2. An oiling apparatus according to claim 1 wherein said oil pump comprises a cylinder and a piston reciprocable in the cylinder.

3. An oiling apparatus according to claim 2 including a check valve in the pump inlet, allowing oil to pass into the cylinder through the inlet and preventing oil from passing out of the cylinder through the inlet.

4. An oiling apparatus according to claim 3 wherein the pump inlet and outlet are located at opposite ends of the cylinder, and the piston is located between the outlet and inlet, thereby to divide the cylinder into an inlet and between the piston and the inlet and an outlet inbetween the piston and the outlet.

5. An oiling apparatus according to claim 4 including an oil passage through the piston and a check valve normally closing said oil passage, said check valve being constructed and arranged to allow the passage of oil from the inlet side of the piston to the outlet side thereof, while preventing oil flow in the opposite direction.

6. An oiling apparatus according to claim 5 including a piston rod connected to the piston and extending through an inlet head closing the inlet end of the cylinder.

7. An oiling apparatus according to claim 6 including an oil pressure relief valve in said piston, adept to open in response to a pressure in the outlet end of the cylinder greater than a predetermined pressure, and to pass oil from the outlet end of the cylinder through the piston to the inlet end.

8. An oiling apparatus according to claim 1 wherein the oil pressure switch is mounted on the outlet of the pump.

* * * * *